United States Patent [19]

Niemeyer

[11] Patent Number: 4,843,199

[45] Date of Patent: Jun. 27, 1989

[54] GAS-BLAST CIRCUIT BREAKER

[75] Inventor: Lutz Niemeyer, Birr, Switzerland

[73] Assignee: BBC Brown, Boveri AG, Switzerland

[21] Appl. No.: 129,728

[22] Filed: Dec. 7, 1987

[30] Foreign Application Priority Data

Dec. 8, 1986 [CH] Switzerland ..... 4883/86

[51] Int. Cl.[4] ..... H01H 33/70

[52] U.S. Cl. ..... 200/148 R

[58] Field of Search ..... 200/148 R

[56] References Cited

FOREIGN PATENT DOCUMENTS

| | | |
|---|---|---|
| 0195904 | 2/1986 | European Pat. Off. . |
| 2633093 | 1/1978 | Fed. Rep. of Germany . |
| 3323865A1 | 11/1983 | Fed. Rep. of Germany . |
| 3424966A1 | 1/1986 | Fed. Rep. of Germany . |
| 1004807 | 12/1951 | France . |
| 2033063 | 11/1970 | France . |
| 2447091 | 8/1980 | France . |
| 1321812 | 7/1973 | United Kingdom . |

*Primary Examiner*—Robert S. Macon

*Attorney, Agent, or Firm*—Ostrolenk, Faber, Gerb & Soffen

[57] ABSTRACT

A gas-blast circuit breaker has two switching elements disposed in a casing filled with arc-extinguishing gas and capable of being brought into or out of engagement with each other along one axis. One of these two switching elements defines an arc-extinguishing jet nozzle and can be guided during switching-off through a heating chamber. The heating chamber stores which is formed by heating up arc-extinguishing gas pressurized gas by means of a switching arc. When low currents are switched, a comparatively high pressure is built up in the heating chamber. On the other hand, a relatively low pressure develops during switching of large currents. This results from the inclusion in the second switching element of an insulation capping which extends around the outer surface and reaches to the front end face thereof, an arcing contact on its outer surface which receives the switching arc during the heating up phase of the switching process and also an arc-extinguishing contact which is separated from the arcing contact by the capping. The root point of the switching arc is commuted, shortly before the current to be switched off passes through zero, to the arc-extinguishing contact.

13 Claims, 1 Drawing Sheet

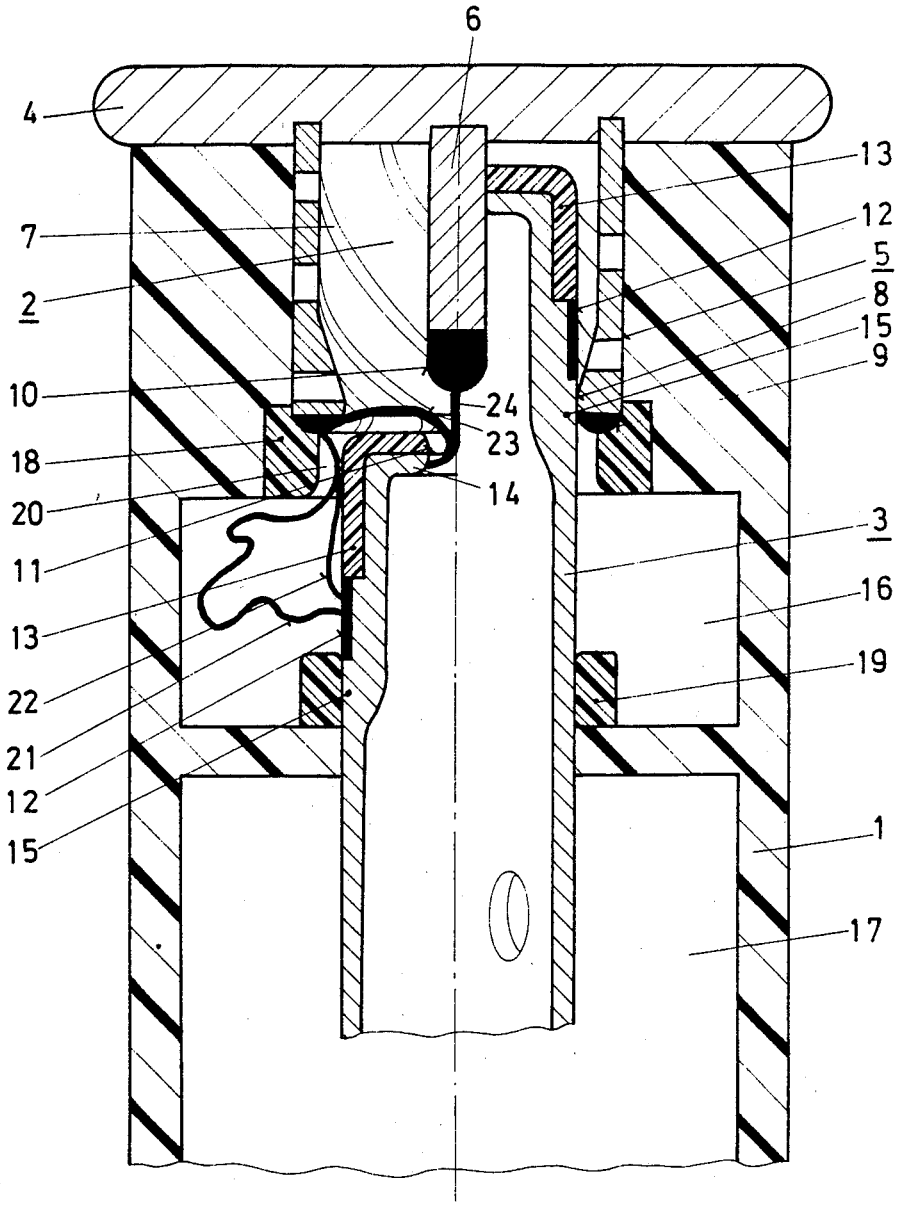
6
4
13
12
7
5
2
8
15
9
10
24
23
18
14
20
3
11
16
13
19
22
21
12
1
15
17

GAS-BLAST CIRCUIT BREAKER

TECHNICAL FIELD

The invention relates to a gas-blast circuit breaker having a casing containing arc-extinguishing gas, two switching elements which can be brought into or out of engagement with each other in the casing along one axis, which are cylindrically constructed and which each have an arcing contact, of which switching elements a first is attached to the casing and a second is constructed as arc-extinguishing jet and can be guided during switching-off through a heating chamber enclosed by the casing for storing pressurized gas which is formed by heating up arc-extinction gas by means of a switch arc struck after separation of the arcing contacts.

PRIOR ART

A circuit breaker of the abovementioned type is known from EP-A10,195,904. The known circuit breaker has a heating chamber which accommodates the switch arc and which can be connected to an expansion chamber via a movable switching element, constructed as an arc-extinguishing jet, and a suitably dimensioned exhaust pipe. In this switch, however, if low currents are switched the development of thermally efficient arc instabilities may be impeded. If large currents are switched, the arc-extinguishing pressure build-up is produced by the arc constriction in the arc-extinguishing jet and therefore increases quadratically with the current. In the case of said circuit breaker, the pressure built up in the heating chamber by the arc on switching low currents may possibly be too low and the pressure built up in the heating chamber by the arc on switching large currents may possibly be too high.

DESCRIPTION OF THE INVENTION

The invention is based on the concept of providing a circuit breaker of the aforementioned type in which a comparatively high pressure is built up in the heating chamber by the switch arc on switching low currents and, on the other hand, a comparatively low pressure is built up on switching large currents.

The gas-blast circuit breaker according to the invention is remarkable for the fact that the pressure of the arc-extinguishing gas in the heating chamber is increased compared with the pressure in comparable switches at low currents and is reduced at high currents. Unnecessarily high pressure build-up in the heating chamber and undesirable jet burn-up are therefore avoided and both low and large currents can be reliably switched.

BRIEF DESCRIPTION OF THE DRAWING

The invention is explained in more detail below with reference to an exemplary embodiment shown in the drawing. Here the only FIGURE shows a view of a section through a gas-blast circuit breaker, embodied according to the invention, in which the gas-blast circuit breaker is shown in the left-hand part of the figure during switch-off and in the right-hand part in the switch-on condition.

METHOD OF EMBODYING THE INVENTION

The gas-blast circuit generator shown in the figure has a casing which is filled with an arc-extinguishing gas such as, for instance, sulphur hexafluoride, which is made of insulating material and in which two cylindrically constructed switching elements 2 and 3 are disposed coaxially to each other. Both switching elements 2 and 3 can be brought into or out of engagement with each other along their common axis.

A first one of the elements, namely element 2 is connected rigidly in an electrically conducting manner to a power supply terminal 4 attached to the casing 1 and is formed of a hollow cylindrical contact element 5 and also a pin contact 6 disposed coaxially hereto. The contact element 5 is subdivided by helically extended slots 7. It carries on its inside surface a ring-shaped rated-current contact 8 and at its free end a ring-shaped arc-ing contact 9. The pin contact 6 carries at its free end a cap 10 of erosion-resistant material such as graphite.

The second element 3 of the two switching elements 2 and 3 can be moved upwards or downwards by a drive system (not shown) in the direction of the switching element axis and is in electrically conducting contact with a stationarily disposed power supply contact (not shown) via a sliding contact (also not shown). The switching element 3 is constructed at its free end as arc-extinguishing jet 11 and has on its cylindrical outside surface a ring-shaped arcing contact 12 and also a capping 13 of insulating material which consists preferably of polytetrafluoroethylene (PTFE) and which extends across the outer surface of the switching element 3 onto its end face and separates the arcing contact 12 from an arc-extinguishing contact 14 which forms the narrow point of the arc-extinguishing jet 11. The cylindrical outside surface of the switching element 3 is constructed as a ring-shaped rated-current contact 15 below the arcing contact 12.

In the casing 1, a heating chamber 16 which is disposed coaxially to the switching elements 2 and 3 and which is sealed off in the switched-on position of the gas-blast circuit breaker and an expansion chamber 17 connected to the interior of the switching element 3 or the arc-extinguishing jet 11 are furthermore provided. The heating chamber 16 has two rings 18 or 19 of insulating material, which are disposed coaxially to the switching elements 2 and 3, of a material, such as, for instance, PTFE with, for example, 7% molybdenum sulphide added, which is strongly quenching under the action of an arc. A first 18 of these two rings of insulating material is disposed at the free end of the switching element 2 in a manner such that, in the course of the switching-off movement of the second switching element 3, it forms, together with the capping 13 of insulating material of the latter, a discharge channel 20 connecting the heating chamber 16 to the interior of the arc-extinguishing jet 11 (lefthand part of the figure). A second 19 of these two rings of insulating material is disposed in the interior of the heating chamber 16 at its wall facing away from the discharge channel 20.

The gas-blast circuit breaker operates as follows: in the switched-on state (right-hand part of the figure) the contact element 5 of the switching element encompasses and frictionally engages the switching element 3. The current flows from the power supply contact 4 via the contact element 5, the rated-current contacts 8 and 15 to the switching element 3 and from there via the sliding contact which is not shown to the power supply contact which is not shown. At the same time the opening of the arc-extinguishing jet 11 encompasses the pin contact 6. The heating chamber 16 which is filled with arc-extinguishing gas is sealed off and has no connection to the interior of the arc-extinguishing jet 11 or the switching element 3 and the expansion chamber 17.

On the switching off, the switching element 3 is moved downwards and the two rated-current contacts 8 and 15 are opened first. The current to be switched off now flows via the arcing contacts 9 and 12. After the arcing contacts 9 and 12 are opened, an arc is struck which burns between said contacts and which is extended into the heating chamber 16 in the course of the subsequent switching-off movement (left-hand part of the figure). The arc can develop freely in the heating chamber 16. The route of the arc at the contact element 5 is influenced by a magnetic field owing to the helical slots 7 and therefore rotates on the arcing contact 9 around the axis of the switching element. As a result, burning-up of the arcing contact 9 and of the capping 13 of insulating material is reduced. At low currents, the arc denoted by the reference numeral 21 is able to develop instabilities and to considerably extend itself. It then produces a comparatively high heating capacity. At high currents, on the other hand, the arc identified with reference numeral 22 has a comparatively stable shape and therefore developed in shortened form. It then produces a comparatively lower heating capacity. Compared with comparable circuit breakers according to the state of the art, the pressure of the arc-extinguishing gas stored by the heating chamber 16 is higher at low currents and lower at high currents.

During a large part of the arcing time, a discharge of the arc-extinguishing gas placed under excess pressure by the arc 21 or 22 through the arc-extinguishing jet 11 is prevented since the capping 13 of insulating material is guided in the contact element 5 during a large part of the switching-off process. As a result, the pressure build-up of the arc-extinguishing gas present in the heating chamber 16 is further increased. During the heating-up phase of the arc-extinguishing gas present in the heating chamber, the ring 19 of insulating material evolves insulating gas which blows the arc 21 or 22 away from the rated-current contact 15 and consequently protects the latter from burn-up.

Only shortly before the end of the stroke of the switching element 3 is reached are the discharge channel 20 and, consequently, also the gas passage through the arc-extinguishing jet 11 into the expansion chamber 17 unblocked. The arc-extinguishing jet 11 does not therefore participate in the pressure build-up and, in addition, does not have to carry the arc during the entire duration of the short circuit. It is only shortly before the current becomes zero that the arc-extinguishing contact 14 which forms the narrow point of the arc-extinguishing jet 11 henceforth takes over the arc provided with the reference symbol 23 in order to extinguish it. The switching of the arc 21 or 22 to the arc-extinguishing contact 14 is in this case effected by the radial gas flow from the heating chamber 16 to the expansion chamber 17 which sets in after the discharge channel 20 is unblocked. The ring 18 of insulating material always supports the switching of the arc by releasing insulating vapor. By the switching of the arc root point from the arcing contact 9 to the pin contact 6, the centering of the arc henceforth denoted by 24 on the axis of the arc-extinguishing zone is additionally facilitated.

I claim:

1. A gas-blast circuit breaker, comprising:

a casing filled with an arc-extinguishing gas;

a first, cylindrically shaped, switching element secured to said casing and having a first arcing contact;

a second, cylindrically shaped, switching element, mounted to move into and out of engagement with said first switching element along a common axis of said switching elements and having a nozzle shaped forward end and a second arcing contact disposed on an exterior surface of said switching element;

an arc-extinguishing-contact adjacent a forward free end of said second switching element and a capping of insulating material extending from said second arcing contact of said second switching element to said arc-extinguishing-contact thereof; enable an arc, drawn during a switching-off operation of said circuit breaker, to freely develop between said respective first and second arcing contacts of said first and second switching element; and an expansion chamber defined by said casing and effective for collecting arc-extinguishing gas generated by an arc developing in said heating chamber, said heating chamber and expansion chamber being so disposed relative to one another as to cause said arc to initially develop between said respective first and second arcing contacts and to be, thereafter and shortly before a current to be switched off passes through zero, commuted through the action of said of arc-extinguishing gas to said arc-extinguishing contact of said second switching element.

2. The gas-blast circuit breaker as in claim 1, wherein said forward free end of said second switching element narrows in cross-section toward said axis of said second switching element and wherein said capping of insulating material and said arc-extinguishing contact extend to the forward free end.

3. The gas-blast circuit breaker of claim 1, wherein the capping of insulating material and the arc-extinguishing contact form the narrow point of an arc-extinguishing jet nozzle.

4. The gas-blast circuit breaker of claim 2, wherein the first switching element has an axially extending pin contact in a position for enabling an arc to form between the pin contact and the arc-extinguishing contact.

5. The gas-blast circuit breaker of claim 1, wherein the first switching element has at least one helically formed slot.

6. The gas-blast circuit breaker of claim 1, wherein the heating chamber has at least one ring of insulating material disposed coaxially to the first and second switching elements.

7. The gas-blast circuit breaker of claim 6, wherein the at least one ring of insulating material contains a material which is strongly arc quenching under the action of an arc.

8. The gas-blast circuit breaker of claim 6, wherein the at least one ring includes a first ring of insulating material disposed at a free end of the first switching element in a location such that, during switching-off of said circuit breaker the second switching element forms, together with the capping a discharge channel connecting the heating chamber to an interior of the expansion chamber.

9. The gas-blast circuit breaker of claim 8, wherein the at least one ring includes a second ring of insulating material which is disposed in the heating chamber at a wall thereof facing and furthest removed from said discharge channel.

10. The gas-blast circuit breaker of claim 7, wherein the at least one ring includes a first ring of insulating material disposed at a free end of the first switching element in a location such that, during switching-off of said circuit breaker the second switching element forms, together with the capping, a discharge channel connecting the heating chamber to an interior of the expansion chamber.

11. A gas-blast circuit breaker, comprising:

a casing for being filled with an arc-extinguishing gas;

a first switching element having a first arcing contact disposed on a front end of said first switching element;

a second switching element having a second arcing contact disposed on an exterior surface of said second switching element, an arc-extinguishing-contact formed on a forward end of said second switching element, and an insulation capping extending from the forward end to the second arcing contact;

a gas heating chamber and a gas expansion chamber defined in the casing;

said first and second switching elements, said first and second contacts, said arc-extinguishing-contact, said insulation capping, said heating chamber, and said expansion chamber being so disposed relative to one another that during an initial phase of a switching-off operation of said circuit breaker an arc develops between said first and second arcing contacts, said arc extending into said heating chamber and being effective to heat arc-extinguishing gas to blow said arc such that said arc is commuted from said second arcing contact to said arc-extinguishing-contact of said second switching element.

12. The gas-blast circuit breaker of claim 11, further comprising arc quenching gas producing means disposed in said heating chamber.

13. The gas-blast circuit breaker of claim 12, wherein the forward end of said second switching element has a nozzle shape and a portion thereof extends radially inwardly and wherein said insulation capping has a first portion which extends axially along the exterior surface of said second switching element and a second portion which extends along said radially extending portion of said second switching element and wherein said first portion of said insulation capping is larger than said second portion thereof.

* * * * *